US005433583A

United States Patent [19]

Sasou et al.

[11] Patent Number: 5,433,583

[45] Date of Patent: Jul. 18, 1995

[54] CARD LOADING DEVICE

[75] Inventors: Hiroshi Sasou; Tomoki Kaya; Mitsuhiro Okazaki; Tosiaki Watanabe; Shinji Fukaya, all of Tokyo, Japan

[73] Assignee: Tamura Electric Works, Ltd., Tokyo, Japan

[21] Appl. No.: 214,855

[22] Filed: Mar. 18, 1994

[30] Foreign Application Priority Data

Mar. 19, 1993 [JP] Japan ..... 5-018126 U

[51] Int. Cl.[6] ..... B65G 59/02

[52] U.S. Cl. ..... 414/797.3; 414/933; 414/796.7; 271/259

[58] Field of Search ..... 414/796.7, 797.2, 797.3, 414/933, 934; 271/225, 258, 259, 902; 221/13, 21, 231, 227; 194/200

[56] References Cited

U.S. PATENT DOCUMENTS 4,560,157 12/1985 Hirschberg ..... 414/933

5,104,111 4/1992 Matsuda et al. ..... 414/797.3

*Primary Examiner*—Michael S. Huppert

*Assistant Examiner*—Douglas A. Hess

*Attorney, Agent, or Firm*—Blakely, Sokoloff, Taylor & Zafman

[57] ABSTRACT

A card loading device includes an elevator, a roller, a card loading port, and two sensors for detecting the feeding of cards, exhausting the feeding of cards and the reloading of cards. The elevator raises/lowers a plurality of accumulated cards. The roller is arranged at a card feed position and rotated clockwise to feed a card located at an uppermost position of the accumulated cards and brought into contact with the roller when the elevator is raised. The card loading port has an opening slightly larger than a thickness of a card and loads a card fed by the roller. The two sensors can detect the proper and the improper loading of a fed card at the card loading port. When a card has been improperly loaded, the sensors send a signal that reverses the roller direction (counterclockwise) and lowers the elevator, thereby exhausting the card from the card loading port. When the card loading port is empty, the sensors send another signal, again reversing the roller direction (clockwise) and raising the elevator, thus reloading the cards into the loading port.

6 Claims, 3 Drawing Sheets

CARD LOADING DEVICE

BACKGROUND OF THE INVENTION

The present invention relates to a card loading device for sequentially loading accumulated non-recorded cards when information is to be recorded on the cards.

In a general card issue apparatus for loading a non-recorded card on which no information is recorded and recording information on the non-recorded card, a card loading device for loading accumulated non-recorded cards one by one is arranged. A card loading device of this type includes a card accumulating section for accumulating a large number of non-recorded cards and a card loading section for loading the non-recorded cards from the card accumulating section one by one. The card accumulating section comprises an elevator for accumulating a predetermined number of non-recorded cards and raising and lowering them, a roller for feeding a non-recorded card, and a motor for rotating the roller. When the conventional card loading device arranged as described above receives a card issue instruction upon a predetermined operation for an external apparatus, the device raises the elevator to raise the accumulated non-recorded cards, thereby bringing the non-recorded card accumulated at the uppermost position into contact with the roller arranged at the card feed position. The motor interlocked with the roller is rotated to rotate the roller in the feed direction, and the cards are fed to the loading port of the card loading section one by one by the rotational force of the roller.

However, the non-recorded cards accumulated on the elevator of the card loading device are attracted to each other by electrostatic charges, and, for example, two cards are simultaneously fed to the loading port of the card loading section, thereby causing an error. In this case, according to a conventional technique, an operator monitors the above card feed error to stop the operation of the card loading device each time the card feed error occurs and to inform the error. For this reason, the card loading device is frequently stopped, and the operating efficiency of the card issue apparatus including the card loading device decreases.

SUMMARY OF THE INVENTION

It is an object of the present invention to provide a card loading device whose operating efficiency is improved by reliably loading cards.

In order to achieve the above objects, according to the present invention, there is provided a card loading device comprising an elevator for raising/lowering a plurality of accumulated cards, a roller which is arranged at a card feed position and rotated clockwise to feed a card located at an uppermost position of the accumulated cards and brought into contact with the roller when the elevator is raised, a card loading port, having an opening slightly larger than a thickness of a card, for loading a card fed by the roller, detecting means for detecting loading of a card fed at the card loading port, card exhausting means for determining a card loading error when the detecting means does not detect loading of a card, and sequentially rotating the roller counterclockwise and lowering the elevator, thereby exhausting the card from the card loading port, and reloading means for raising the elevator and rotating the roller clockwise to reload the card exhausted by the card exhausting means.

DESCRIPTION OF THE PREFERRED EMBODIMENT

The present invention will be described below with reference to the accompanying drawings.

Figure 1:
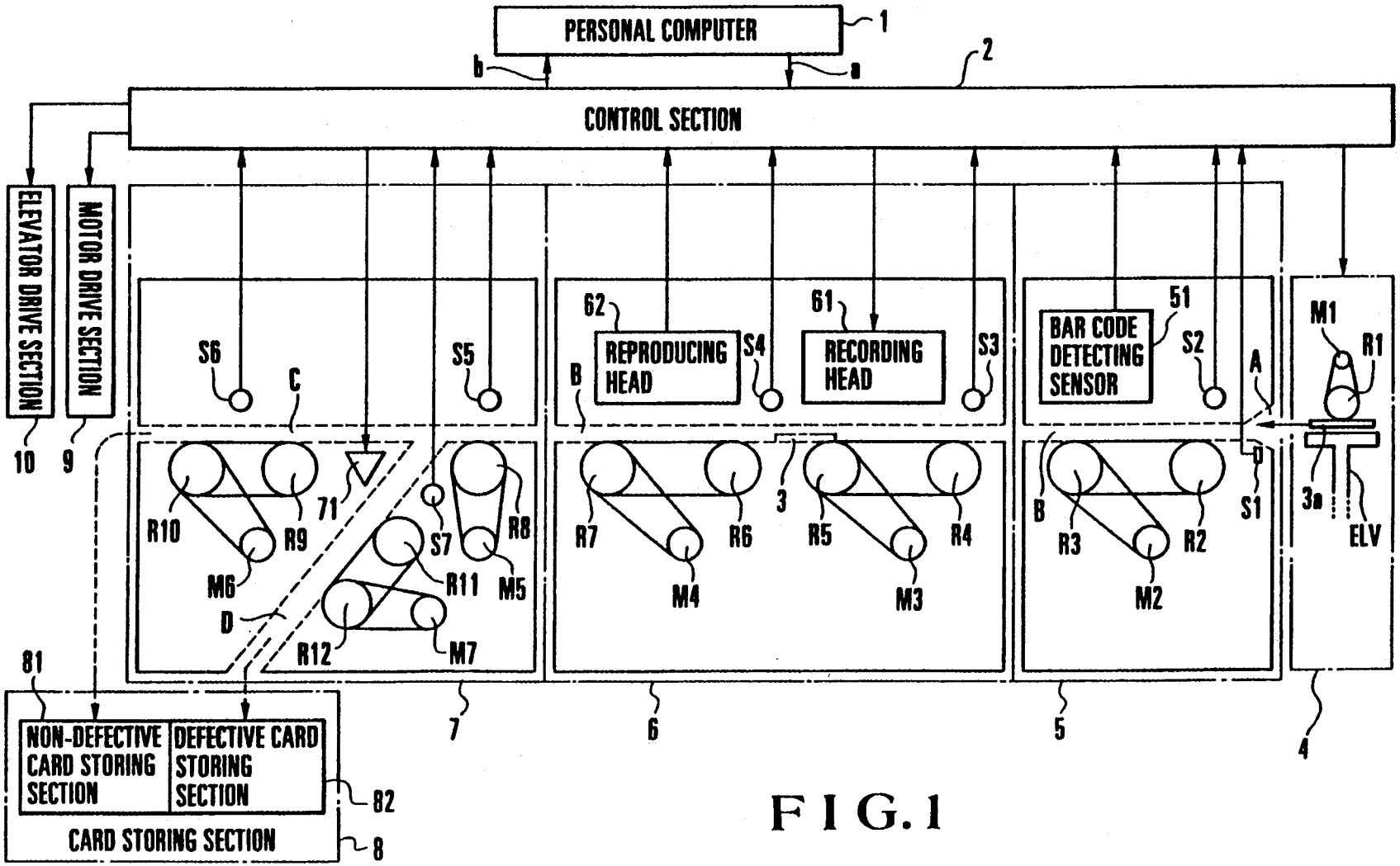
FIG. 1 is a block diagram showing an embodiment of a card issue apparatus including a card loading device according to the present invention.

FIG. 1 shows an embodiment of a card issue apparatus including a card loading device according to the present invention. Referring to FIG. 1, this card issue apparatus is a magnetic card issue apparatus for magnetically recording value information on a magnetic card to issue the card, and is constituted by a personal computer 1 for designating a card issue operation, a control section 2 for controlling the overall card issue operation, a card accumulating section 4 for accumulating a predetermined number of non-recorded cards 3*a* on which no value information is recorded, a card loading section 5 for loading the non-recorded cards 3*a* fed from the card accumulating section 4 one by one, a recording/reproducing section 6 for recording/reproducing value information corresponding to a prepaid amount on/from each of the non-recorded cards 3*a* , a selector section 7 for checking whether the card 3 on which value information is recorded is defective/non-defective, a card storing section 8 for storing the card 3 checked by the selector section 7, a motor drive section 9 for driving a motor (to be described later) for conveying cards, and an elevator drive section 10 for driving an elevator (to be described later) of the card accumulating section 4.

Reference numeral 51 denotes a bar code detecting sensor for detecting a common bar code indicating a card issuer, card identification information, and the like pre-recorded on the non-recorded card 3*a* loaded by the card loading section 5; 61, a recording head for recording value information on the card 3*a* conveyed from the card loading section 5 to the recording/reproducing section 6; 62, a reproducing head for reproducing the value information recorded on the card 3*a* ; and 71, a selector lever for sorting cards into non-defective/defective cards. Reference symbol A denotes the card loading port of the card loading section 5B to D, card convey paths on which the cards 3 and 3*a* are conveyed; S1 and S2, sensors for detecting loading of the non-recorded card 3*a* ; S3 to S7, sensors for detecting the card 3 conveyed on the card convey paths B to D; ELV, an elevator arranged in the card accumulating section 4 and designed to raise and lower the accumulated non-recorded card 3*a* ; R1, a roller for feeding the non-recorded card 3*a* to the convey path A; R2 to R12, rollers for conveying the card 3 on the convey paths B to D; and M1 to M7, motors for driving the rollers R1 to R12.

The card accumulating section 4 is constituted by the elevator ELV, the roller R1, and the motor M1, and the card loading section 5 has the card convey path B and is constituted by the bar code detecting sensor 51, the sensors S1 and S2, the rollers R2 and R3, and the motor M2. The recording/reproducing section 6 has the card convey path B and is constituted by the recording head 61, the reproducing head 62, the sensors S3 and S4, the rollers R4 to R7, and the motors M3 and M4. The selector section 7 has the card convey paths C and D and is constituted by the selector lever 71, the sensors S5 to S7, the rollers R8 to R12, and the motors M5 to M7.

An operation of the card issue apparatus arranged as described above will be described below.

When the predetermined number of non-recorded cards 3*a* are accumulated in the card accumulating section 4, and an operator performs a card issue operation using the personal computer 1, a card issue command signal a is sent to the control section 2. The control section 2 controls the elevator drive section 10 to raise the elevator ELV in the card accumulating section 4 and to raise the non-recorded cards 3*a* on the elevator ELV, thereby bringing the non-recorded card 3*a* into contact with the roller R1. The motor drive section 9 is controlled to drive the motor M1 and to rotate the roller R1 interlocked with the motor M1. As a result, the non-recorded cards 3*a* are sent to the loading port A of the card loading section 5 one by one.

When each of the non-recorded cards 3*a* is loaded into the loading port A of the card loading section 5, the control section 2 detects and confirms the loading of the card 3*a* through the sensors S1 and S2. When the control section 2 determines that the non-recorded card 3*a* is present in the card loading section 5, the control section 2 drives the motor drive section 9 to rotate the motors M2 to M7 at a predetermined speed such that the card 3*a* is conveyed on the convey paths B to D at a predetermined speed.

In this case, the control section 2 causes the bar code detecting sensor 51 to detect a common bar code attached to the non-recorded card 3*a* in advance so as to check whether value information can be recorded on the non-recorded card 3*a* . If the value information can be recorded on the non-recorded card 3*a* , the control section 2 causes the sensor S3 to check whether the card 3*a* has reached the recording/reproducing section 6. If the control section 2 detects that the card 3*a* has reached the recording/reproducing section 6, the control section 2 drives the recording head 61 to record predetermined value information on the card 3*a* . Upon completion of recording on the card 3, the control section 2 confirms, through the sensor S4, that the card 3 is close to the reproducing head 62 in the recording/reproducing section 6, and causes the reproducing head 62 to reproduce the value information recorded on the card 3.

The control section 2 checks the reproduced information from the reproducing head 62. If the control section 2 determines that the value information is properly recorded on the card 3, the control section 2 confirms, through the sensor S5, that the card 3 has reached the selector section 7. The control section 2 then drives a solenoid (not shown) to switch the selector lever 71 such that the card 3 is conveyed on the convey path C. As a result, the card 3 is conveyed on the convey path C and stored in a non-defective card storing section 81 in the card storing section 8. On the other hand, when it is determined, on the basis of the result obtained by checking the reproduced information from the reproducing head 62 of the recording/reproducing section 6, that the value information is not properly recorded on the card 3, or when it is determined, on the basis of the result obtained by checking bar cord information from the bar code detecting sensor 51 of the card loading section 5, that the bar cord is not properly attached to the card 3, the control section 2 determines that the card 3 is a defective card, and sets the selector lever 71 in an inoperative state. With this operation, the defective card is stored in a defective card storing section 82 through the convey path D.

Figure 2:
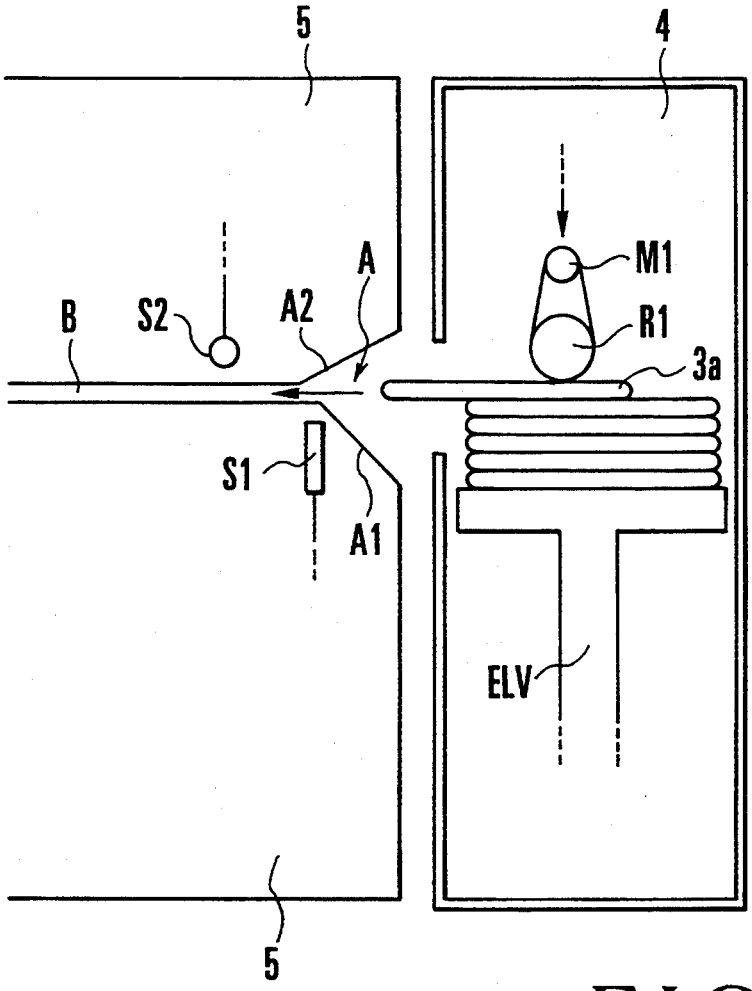
FIG. 2 is a sectional view showing the main part of the card loading device shown in FIG. 1.

FIG. 2 shows the main part of the card loading device of the card issue apparatus shown in FIG. 1. This card loading device is constituted by the card accumulating section 4 and the card loading section 5.

An operation performed when the non-recorded card 3*a* is loaded will be briefly described below. The elevator ELV of the card accumulating section 4 is raised to bring the non-recorded card 3*a* into contact with the roller R1 arranged at the feed position, so that the non-recorded card 3*a* accumulated at the uppermost position is fed to the loading port A of the card loading section 5 by the rotation of the roller R1. When the non-recorded card 3*a* is conveyed from the card loading port A to the convey path B, the elevator ELV is slightly raised by a distance corresponding to the thickness of the card 3. With this operation, the next non-recorded card 3*a* accumulated on the uppermost portion is brought into contact with the roller R1, and the next non-recorded card 3*a* is fed to the card loading port A by the rotation of the roller R1. In this manner, the cards 3*a* are fed to the card loading section 5 one by one, and the card 3*a* is loaded into the card loading port A of the card loading section 5.

When the non-recorded card 3*a* is loaded as described above, it is detected through the sensor S2 arranged near the card loading port A whether the non-recorded card 3*a* is properly loaded.

Figure 3A:
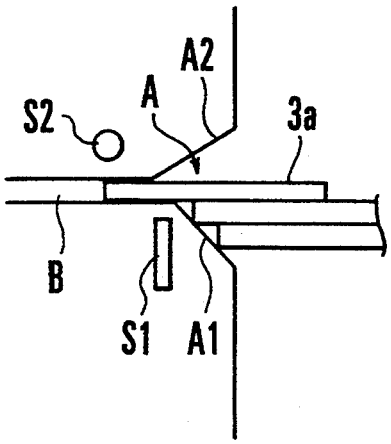
FIGS. 3A and 3B are sectional views for explaining states in which cards are loaded by the card loading device shown in FIG. 2.

That is, as shown in FIG. 3A, the opening of the convey path B is formed to be slightly larger than the thickness of one card, taper portions A1 and A2 for guiding the card 3*a* are formed on the corners of the card loading port A in the direction of thickness of a card. In addition, the loading sensor S1 is arranged at a portion where the convey path B and the taper portion A1 of the card loading port A communicated with each other, and the sensor S2 is arranged on the convey path B at a position farther from the card accumulating section 4 than the sensor S1 . The taper portion A1 has an angle larger than that of the taper portion A2 in the card convey direction and communicates with the convey path B at a position nearer to the card accumulating section 4 than the taper portion A2. The sensor S1 is arranged at an end position below the convey path B, above which the taper portion A2 is formed. With this structure, the non-recorded cards 3*a* are reliably loaded into the convey path B one by one. Even when a plurality of cards 3*a* attracted to each other are fed from the card accumulating section 4, the leading end of the card 3*a* can be detected by the sensor S1.

Figure 3B:
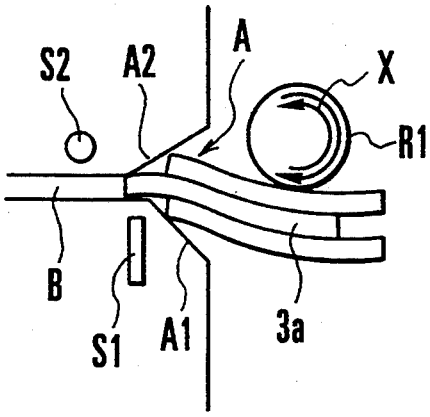

In the above structure, when only one of the cards 3*a* is properly loaded into the card loading port A, the sensor S2 is turned on because the leading end of the card 3*a* reaches the sensor S2 on the convey path B. On the other hand, assume that the cards 3*a* are attracted to each other by electrostatic charges or the like, and a plurality of cards 3*a* are simultaneously fed into the card loading port A. In this case, as shown in FIG. 3B, the leading ends of some of the cards 3*a* attracted to each other are brought into contact with the taper portions A1 and A2 of the loading port A, and the cards 3*a* are not loaded into the card loading port A. For this reason, the leading end of any of the cards 3a does not reach the sensor S2, and the sensor S2 is not turned on. When the control section 2 detects that the sensor S2 is not turned on, the control section 2 controls the motor drive section 9 to rotate the motor M1 counterclockwise and to rotate the roller R1, interlocked with the motor M1, counterclockwise as indicated by an arrow X. As a result, the cards 3a attracted to each other are drawn from the loading port A and temporarily returned to the card accumulating section 4. Thereafter, the motor M1 is rotated clockwise to feed one of the drawn cards 3a so as to load the card 3a .

Figure 4:
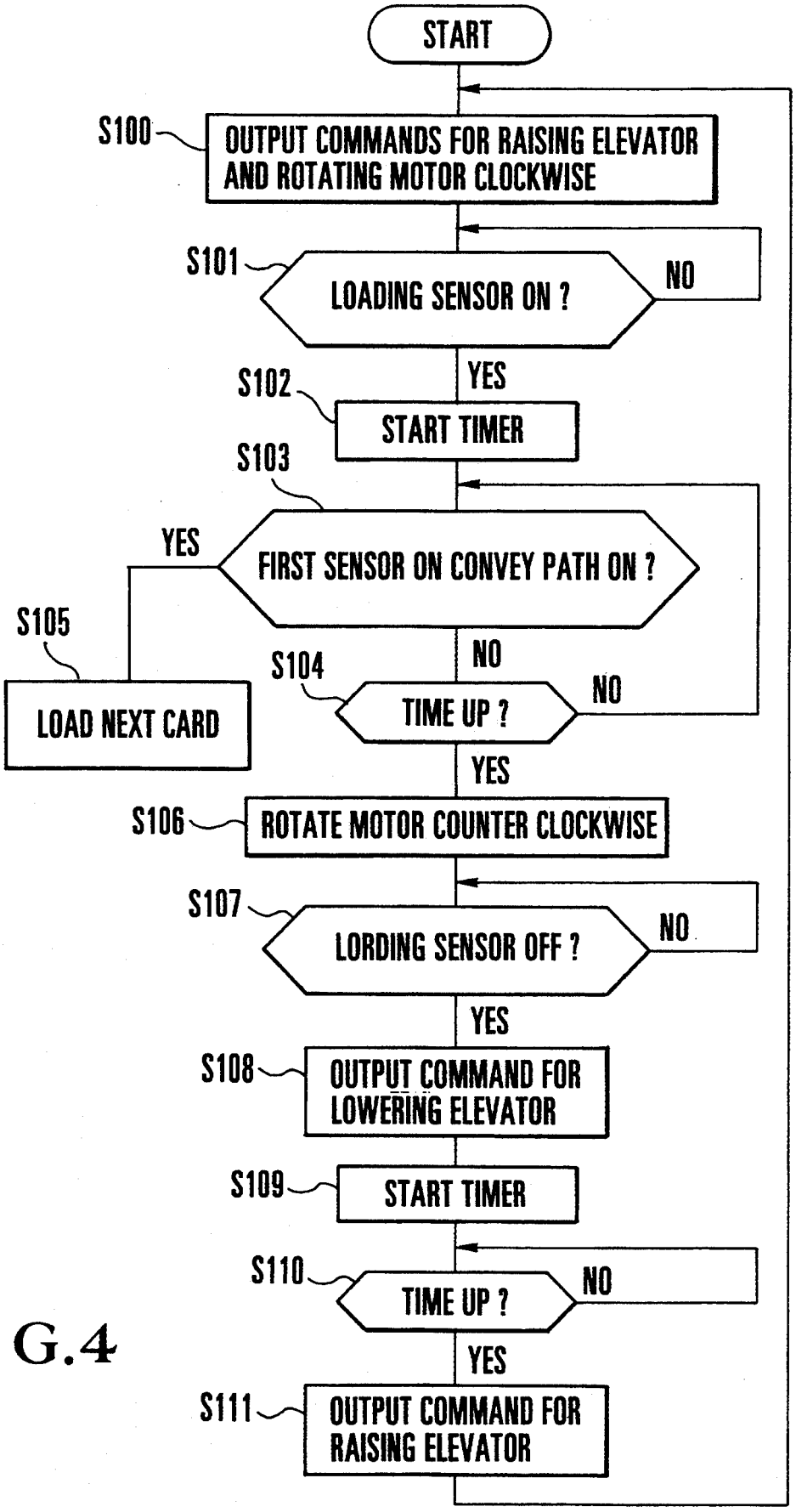
FIG. 4 is a flow chart showing an operation of the card loading device according to the present invention.

FIG. 4 shows an operation of the control section 2 for controlling a loading operation of the card 3a . The loading operation of the non-recorded card 3a will be described below with reference to the flow chart. In this flow chart, a sensor set in an ON state represents detection of a card, and a sensor set in an OFF state represents non-detection of a card.

When card issue is designated from the personal computer 1, the control section 2 loads the non-recorded cards 3a to record value information on the non-recorded cards 3a accumulated in the card accumulating section 4. In this case, the elevator ELV in the card accumulating section 4 is raised to bring one of the non-recorded cards 3a into contact with the roller R1, and the motor M1 is rotated clockwise in step S100 to feed the card 3a to the card loading port A of the card loading section 5. Note that the motor M1 may be rotated clockwise before the elevator ELV is raised. It is checked in step S101 whether the loading sensor S1 arranged at the loading port A is turned on. The card is then fed to the loading port A to turn on the sensor S1, thereby starting a first timer of a predetermined period of time in step 102.

It is checked in step S103 whether the first sensor, i.e., the sensor S2, on the convey path B is turned on. If NO in step S103, it is checked in step S104 whether the period of time of the first timer is up. When the sensor S2 is turned on within the period of time of the first timer, and if YES in step S103, it is determined that the card 3a is properly loaded from the card loading port A into the convey path B, and a loading operation of the next card 3a is started in step S105.

On the other hand, the sensor S2 is not turned on within the period of time of the first timer, if YES in step S104, it is determined that the loading operation of the card 3a into the card loading port A is not properly performed, and the motor M1 is rotated counterclockwise in step S106. In this manner, the roller R1 is rotated counterclockwise, and the card 3a is returned by the counterclockwise rotation of the roller R1. It is checked by detecting the OFF state of the sensor S1 in step S107 whether the card 3a is returned. If it is determined that the card 3a is returned from the loading port A, the elevator ELV is lowered in step S108. A second timer of a predetermined period of time is started in step S109. After it is determined by "YES" in step S110 that a predetermined period of time has elapsed, the elevator ELV is raised again in step S111 to bring the returned card 3a into contact with the roller R1. The flow returns to step S100 to rotate the motor M1 clockwise, and the returned card 3a is fed to the card loading port A again.

As described above, according to the above embodiment, if the card 3a is not properly loaded, the card 3a is temporarily returned and loaded again. As a result, the operation stop of the card loading device and the card issue apparatus caused by a loading error of the card 3a is prevented.

As has been described above, according to the present invention, when a card is to be loaded, the absence/presence of loading of the card is detected. If the loading of the card is not detected, the card is temporarily exhausted from the loading port, and the exhausted card is reloaded. For this reason, the card can be reliably loaded. As a result, the apparatus can be continuously operated, and the operating efficiency of the apparatus advantageously improves.

What is claimed is:

1. A card loading device comprising:

an elevator for raising/lowering a plurality of accumulated cards;

a roller which is arranged at a card feed position and rotated clockwise to feed a card located at an uppermost position of said accumulated cards and brought into contact with said roller when said elevator is raised;

a card loading port, having an opening slightly larger than a thickness of a card, for loading a card fed by said roller;

detecting means for detecting loading of a fed card at said card loading port;

card exhausting means for determining a card loading error when said detecting means does not detect loading of a card, and sequentially rotating said roller counterclockwise and lowering said elevator, thereby exhausting the card from said card loading port; and reloading means for raising said elevator and rotating said roller clockwise to reload the card exhausted by said card exhausting means.

2. A device according to claim 1, further comprising a convey path, communicating with said card loading port, for conveying a card loaded through said card loading port, and wherein said detecting means is constituted by a first sensor arranged at said card loading port and a second sensor arranged at an end position of said convey path, and said card exhausting means determines a card loading error when the second sensor detects no card after said first sensor detects a card.

3. A device according to claim 2, wherein said card exhausting means includes a first timer started when said first sensor detects a card, and determines a card loading error when said second sensor detects no card by the time a period of time of said first timer is up.

4. A device according to claim 2, wherein said card detecting means includes a second timer started when said first sensor detects no card upon counterclockwise rotation of said roller, and lowers said elevator when a period of time of said second timer is up.

5. A device according to claim 2, wherein said card loading port has a pair of taper portions on two corners in a direction of thickness of a card, and a card fed by said roller is guided by the taper portions and loaded into the card loading port.

6. A device according to claim 5, and wherein the pair of taper portions communicate with upper and lower surfaces of said convey path at different positions in a card convey direction, respectively, and said first sensor is arranged between different positions where the taper portions communicate with the convey path.

* * * * *